US006592721B1

(12) United States Patent
Anderson et al.

(10) Patent No.: US 6,592,721 B1
(45) Date of Patent: Jul. 15, 2003

(54) APPARATUS FOR DEWATERING A SUCTION PAPERMAKING ROLL

(75) Inventors: D. W. Anderson, Middletown, NY (US); Robert H. Herring, Cincinnati, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/567,237

(22) Filed: May 11, 2000

Related U.S. Application Data

(60) Provisional application No. 60/134,258, filed on May 12, 1999.

(51) Int. Cl.[7] ..... D21F 1/32

(52) U.S. Cl. ..... 162/274; 162/275; 162/276; 162/279; 162/297

(58) Field of Search ..... 162/199, 272, 162/276, 278, 279, 369, 297, 363, 364, 365, 368, 371, 367, 372, 370, 275

(56) References Cited

U.S. PATENT DOCUMENTS

| | | | | |
|---|---|---|---|---|
| 693,895 A | | 2/1902 | Parker | |
| 1,840,102 A | * | 1/1932 | Jespersen | |
| 1,978,982 A | | 10/1934 | Barstow | |
| 2,107,812 A | | 2/1938 | Berry et al. | |
| 2,274,641 A | | 3/1942 | Abbott et al. | |
| 2,312,519 A | | 3/1943 | Berry | |
| 2,772,606 A | | 12/1956 | Kelly | |
| 2,857,823 A | | 10/1958 | Thiessen | |
| 2,991,218 A | | 7/1961 | Cirrito et al. | |
| 2,998,846 A | | 9/1961 | Hornbostel | |
| 3,160,553 A | | 12/1964 | Ely | |
| 3,190,793 A | * | 6/1965 | Starke | 162/278 |
| 3,252,853 A | | 5/1966 | Holt et al. | |
| 3,300,374 A | | 1/1967 | Baker et al. | |
| 3,455,780 A | | 7/1969 | Hazard et al. | |
| 3,617,441 A | * | 11/1971 | Farrel | 162/199 |
| 3,802,961 A | | 4/1974 | Grass et al. | 162/371 |
| 3,880,711 A | * | 4/1975 | Hayes, Jr. | 162/357 |
| 4,366,025 A | | 12/1982 | Gordon, Jr. et al. | 162/358 |
| 4,693,784 A | | 9/1987 | Aula et al. | 162/202 |
| 4,714,523 A | | 12/1987 | Sawyer, Jr. et al. | 162/371 |

(List continued on next page.)

FOREIGN PATENT DOCUMENTS

| | | | | |
|---|---|---|---|---|
| CA | 595854 | * | 4/1960 | 162/369 |
| DD | 000288412 | * | 3/1991 | |

*Primary Examiner*—Steven P. Griffin
*Assistant Examiner*—Carlos Lopez
(74) *Attorney, Agent, or Firm*—Ostrager Chong & Flaherty

(57) ABSTRACT

An air delivery device is provided for dewatering a suction roll in a paper machine by applying pressurized air to expel residual water or debris outwardly from through-holes. The air delivery device is positioned at a suitable circumferential position of the suction roll to prevent water carryover back to the suction box location. In one preferred embodiment, an internal blowbox is mounted near the inner surface of the suction roll for blowing out water from the suction roll holes to augment the natural centrifugal forces. The blowbox can be used as a standalone dewatering unit, or in conjunction with an external doctor blade or wipe. In another preferred embodiment, at least one air knife, air pipe or air shower is used for dewatering. In another preferred embodiment, at least one interior stationary air foil is used to generate a pressure pulse which creates outward air flow through the through-holes. In still another preferred embodiment, the blowbox may be provided with a self-loading structure for selectively loading it against the inner surface of the suction roll using variable air pressure control. All preferred embodiments can be used as standalone dewatering units, or in conjunction with an external doctor blade, external wipe or external air knife.

11 Claims, 7 Drawing Sheets

U.S. PATENT DOCUMENTS

| | | | | | |
|---|---|---|---|---|---|
| 4,915,791 | A | * | 4/1990 | Rannikko | 162/351 |
| 5,151,156 | A | | 9/1992 | Schiel | 162/368 |
| 5,178,731 | A | | 1/1993 | Kivimaa et al. | 162/199 |
| 5,466,342 | A | | 11/1995 | Kankaanpaa | 162/301 |
| 5,466,343 | A | | 11/1995 | Kankaanpaa | 162/357 |
| 5,580,424 | A | | 12/1996 | Snellman | 162/371 |
| 5,635,034 | A | | 6/1997 | Viitanen et al. | 162/368 |
| 5,746,891 | A | | 5/1998 | Withers | 162/371 |
| 5,944,956 | A | * | 8/1999 | Marcheggiani | 162/199 |
| 6,174,414 | B1 | * | 1/2001 | Theriault | 162/278 |

* cited by examiner

APPARATUS FOR DEWATERING A SUCTION PAPERMAKING ROLL

PRIOR APPLICATION

This patent application incorporates by reference, and claims the benefit of the priority filing date of, U.S. Provisional Application Serial No. 60/134,258 filed on May 12, 1999, by the same inventors, entitled "Method and Device for Removing Water from Holes in a Suction Papermaking Roll".

TECHNICAL FIELD

This invention generally relates to suction roll apparatus used in papermaking, and more particularly, to an apparatus for improved removal of water from holes in a suction roll.

BACKGROUND OF THE INVENTION

In paper production, water is removed from a wet web of paper pulp carried on a felt by passing the web through the nip of a pair of press rolls. A suction roll is commonly used as one of these press rolls for water removal from the paper web. A suction roll contains drilled or through-holes (and may also contain blind holes or grooves) for accommodating water expressed from the web while the web is in the nip. An internal suction box is provided in the suction roll near the nip area. The suction box is stationary and is aligned more or less with the nip contact area. Its purpose is to draw expressed water into the drilled holes. It is desirable that any residual water remaining in the holes after the holes rotate past the suction box be slung or thrown from the holes as the suction roll rotates away from the nip area. However, there is a tendency for some water and debris to remain in the holes, and for water sling or water throw to occur at an undesirable circumferential location, that is, for the residual water to be thrown back into the ingoing felt or web ahead of the nip area. This water "carryover" is detrimental to web dewatering in the nip, and can also cause non-uniform conditions to occur in the web or in the press felt.

In some cases, residual water in the drilled or through-holes may remain in the holes and not be thrown from the roll at any circumferential position. This is also undesirable, as the holes should be free of water and debris at the ingoing side of the nip if optimum water removal efficiency is to be achieved. If residual water remains in the holes, nip dewatering efficiency suffers.

In yet other cases, namely those situations where the suction roll is equipped with a doctor blade, residual water in the through-holes may be expelled only after the holes pass across the doctor blade. This post-blade dewatering results from a momentary negative pressure pulse exerted on the holes as the holes and doctor blade diverge. This too can be undesirable, as water expelled after the doctor blade may be directed towards the ingoing nip, thereby compromising nip dewatering efficiency.

By way of example, a suction press roll is used to describe the present invention. However, this invention applies also to any suction roll that is used for water removal on a paper machine. Such rolls include forming rolls, suction couch rolls, and suction press rolls. Furthermore, forming rolls and couch rolls may not be in contact with a second roll (i.e., there may not be a true nip formed with a second roll). For these rolls, the term "nip" is meant to imply the area adjacent to the suction box in the suction roll.

Conventional suction roll equipment for papermaking has not provided a solution to prevent water sling or carryover to the web. U.S. Pat. Nos. 5,466,342 and 5,466,343 to Kankaanpaa (Valmet) are of interest for disclosing an internal water jet for forcing water and debris out of holes in a suction roll into a water collecting trough. U.S. Pat. No. 4,693,784 to Aula (Valmet) is of interest for disclosing the use of air jets directed tangential to the inner roll surface away from the end zones of the suction area of a suction roll as air seals obviating the need for mechanical seals. U.S. Pat. No. 5,178,731 is also of interest showing the use of a doctor blade to create negative pressure on the roll cover surface, thereby providing a differential pressure in effect to suck water from the holes.

SUMMARY OF THE INVENTION

A principal object of the present invention is to provide a method and apparatus for dewatering through-holes in a suction press roll, suction couch roll, or forming roll to avoid water sling or water carryover back to the felt, wire, or web as the suction roll continues to rotate. A specific object of the invention is to provide for removing the residual water in the holes of a suction roll at a desired circumferential location before it can be carried back to the nip. Another objective is to provide a solution that can be applied to different types of suction rolls and used in the press section, at the couch, or as forming rolls.

In accordance with the invention, a method and apparatus for dewatering a suction roll in a paper machine has an air delivery device mounted in the inner volume of the suction roll for applying a radially outward force against the inner surface of the suction roll shell to expel residual water from the through-holes in the suction roll. The air delivery device is positioned at a suitable circumferential position relative to the suction box to prevent water carryover back to the nip, whether this water would otherwise be physically thrown from the holes to the ingoing felt, web, or wire, or whether this water would otherwise remain in the holes without being thrown. It may be conveniently mounted to the suction box assembly on the inside of the suction roll.

In a first embodiment of the invention, a blowbox is mounted in the inner volume of the suction roll at a circumferential position such that the expelled water will not be thrown back to the ingoing path of the web. It can be used as a standalone dewatering unit or in conjunction with an external doctor blade, wipe, or air knife for removing surface water from the roll.

In a second embodiment of the invention, an air knife is mounted in the inner volume of the roll to blow high velocity air against the inner roll surface. The air knife may be any type of non-contact air delivery system, and may be formed by a series of air knives. It may also be combined with an external doctor blade, wipe, or air knife for removing surface water from the roll.

In a third embodiment of the invention, one or more stationary air foils are positioned inside the suction roll shell to create a positive pressure region (defined herein as a pressure "wedge") which exerts an outward force on the through-holes, thereby expelling residual water. It may also be combined with an external doctor blade, wipe, or air knife for removing surface water from the roll. In addition, low pressure air may be introduced ahead of the air foil(s) to increase the outward force generated by the foils.

In a fourth embodiment of the invention, the leading surface of a blowbox is aerodynamically shaped to act as a stationary foil, with outward forces being generated by both the foil and the blowbox. Low pressure air may be introduced ahead of the shaped surface. It may also be combined with an external doctor blade wipe, or air knife for removing surface water from the roll.

Another feature of the invention is a structure for selectively loading the blowbox against the inner surface of the suction roll. Thus, the blowbox can be positioned against the inner roll surface only when needed.

Other objects, features, and advantages of the present invention will be explained in the following detailed description of the invention having reference to the appended drawings.

DETAILED DESCRIPTION OF THE INVENTION

By way of illustration, application of this invention is described using a bottom suction press roll. It is to be understood, however, that the invention works equally well for suction rolls located on either side of the web. In other press configurations, both press rolls forming the nip may be equipped with internal suction boxes, in which case both rolls will benefit from the invention.

Figure 1:
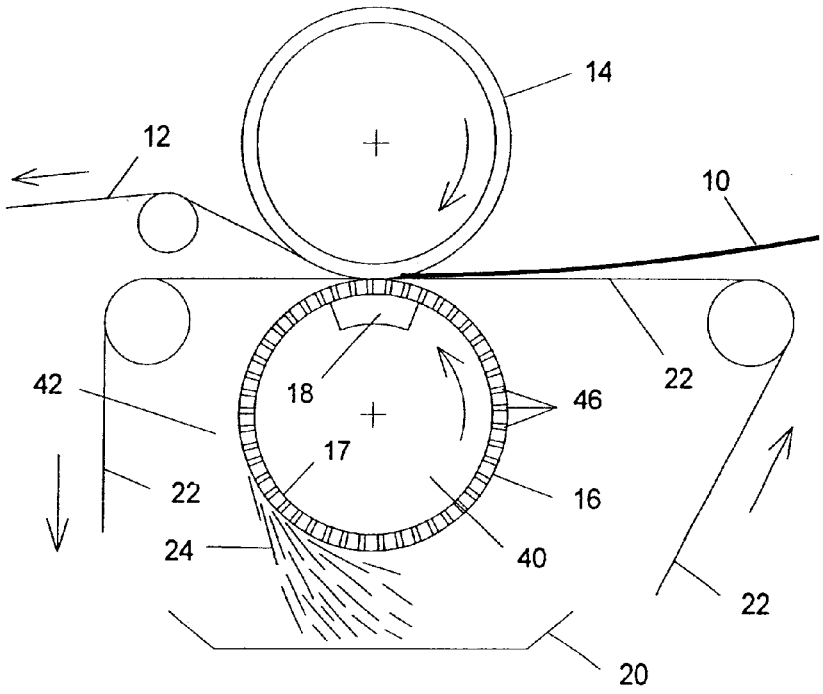
Figure 1 (PRIOR ART)
FIG. 1 illustrates water sling or carryover from a suction press roll at an acceptable or desirable location.
Figure 2:
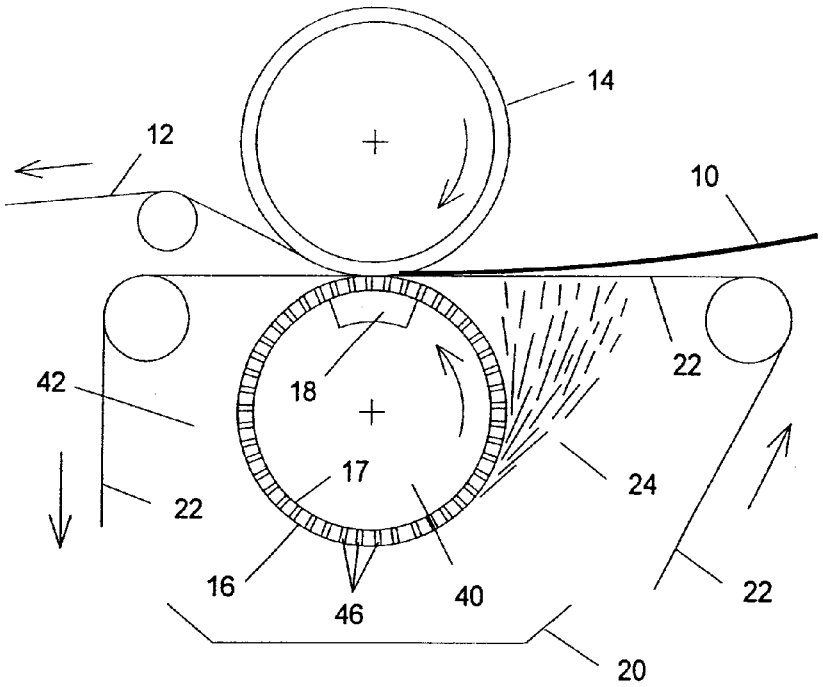
Figure 2 (PRIOR ART)
FIG. 2 illustrates the problem in the prior art of water sling or "carryover" from a suction press roll back to the ingoing web path.

Referring to FIGS. 1 and 2, the problem in the prior art of water sling or water carryover from a suction press roll back to the felt in conventional press roll equipment for papermaking is explained. A suction press roll 16 is commonly used with a second press roll 14 for water removal from a paper web 10 carried on an endless felt 22. Water pressed outward from the paper web 10 in the nip of the press rolls is momentarily held in the suction or through-holes 46 in the nip area by a suction box 18 arranged inside of and in contact with the interior surface 17 of the shell of the suction press roll. For illustration purposes, suction box 18 is shown at approximately the 12 o'clock position in FIGS. 1 and 2. The pressed web output 12 is then conveyed to the further processing and drying stations of the papermaking line.

The suction press roll 16 consists of a metal cylindrical shell containing drilled holes such that it is perforated. A polymer cover (not shown) typically is extruded or cast onto the shell's outer surface. A suction hole or a through-hole is herein defined as a hole which penetrates the roll shell thickness and also the roll cover thickness (if a roll cover has been applied to the shell), such that the interior 40 of the roll is in communication with the region 42 which is exterior to the roll. The purpose of these holes is to accept water expressed through the press felt during it's compression with the web in the press nip. The holes thus allow for a greater degree of water removal in the nip as compared with rolls not having a suction box and through-holes. A covered roll cover was used in the preferred embodiments. However, it is to be understood that an uncovered suction roll will also realize benefit from this invention.

In order to be effective, the through-holes must be relatively devoid of water as the roll cover and press felt enter the nip. As shown in FIG. 1, voiding the holes of water in conventional equipment is often left to be accomplished by centrifugal forces resulting from the rotational speed of the press roll, i.e., the residual water 24 is thrown or slung from the holes into a catch pan 20 at a desired location. A doctor blade or wipe is commonly used to assist the centrifugal forces acting on the residual water and also to remove any water film that may reside on the surface of the roll. Doctor blades are well known in the industry and are discussed in detail in U.S. Pat. No. 5,178,731 to Kivimaa et al. which is incorporated herein by reference.

Press efficiency problems result when residual water is not expelled in a timely manner from the holes in the roll cover. As an example, and as shown in FIG. 2, the residual water 24 can be slung or carried over back to the ingoing side of the press nip, thereby elevating the felt moisture content entering the nip. This is undesirable, as the ingoing felt moisture needs to be as low as possible so that it can absorb a greater amount of water expressed from the web during pressing. High in-going felt moisture can result in lower proportion of web solids to moisture content of pressed web output 12 (requiring the use of lower machine speeds), higher press break frequency, shadow marking of the web, crushing, fines redistribution, premature felt filling, and shortened felt life, among other undesirable outcomes. In addition to elevating overall felt moisture content, water carryover can often produce undesirable web moisture non-uniformity in the cross-machine direction, since the carryover water 24 will most likely not be slung uniformly in degree across the width of the roll 16.

For optimum dewatering in the press nip, the holes in the suction roll should be void of water when entering the nip. So whether the residual water is slung from the holes onto the in-going press felt, or simply remains in the holes, the same undesirable results can occur. The degree of water carryover can depend upon a number of factors, including changes in the surface tension or viscosity of the water, changes in surface energy of the cover or shell material, wear patterns, improper press felt design or felt integrity, pulp and chemical additive properties, conditions in the opposing press felt (if there is one), among other factors. Water carryover is non-uniform in nature and can also change with nip load, machine speed, basis weight, in-going web and felt moisture content, and web temperature, among other factors.

In accordance with the present invention, it is desired to provide forces to promote the expulsion of water from the holes of a suction roll in addition to those resulting from natural centrifugal forces. This is accomplished by mounting a device internally within the inner volume of the suction roll for generating an outward air flow against the inner surface of the suction roll to expel residual water from the holes. In the preferred embodiments, direction of air flow from the device is substantially normal or perpendicular to the surface of the roll shell. The device is positioned at a suitable circumferential position relative to the suction box, depending on press geometry. It can also achieve a cleaning action with the outflow of air by expelling debris collected in the through-holes. The invention may be applied to suction rolls, blind drilled suction rolls, grooved suction rolls, or any combination of such suction rolls. It may be applied to suction rolls in the press section of a papermaking line, as well as to couch rolls and forming rolls.

Figure 3:
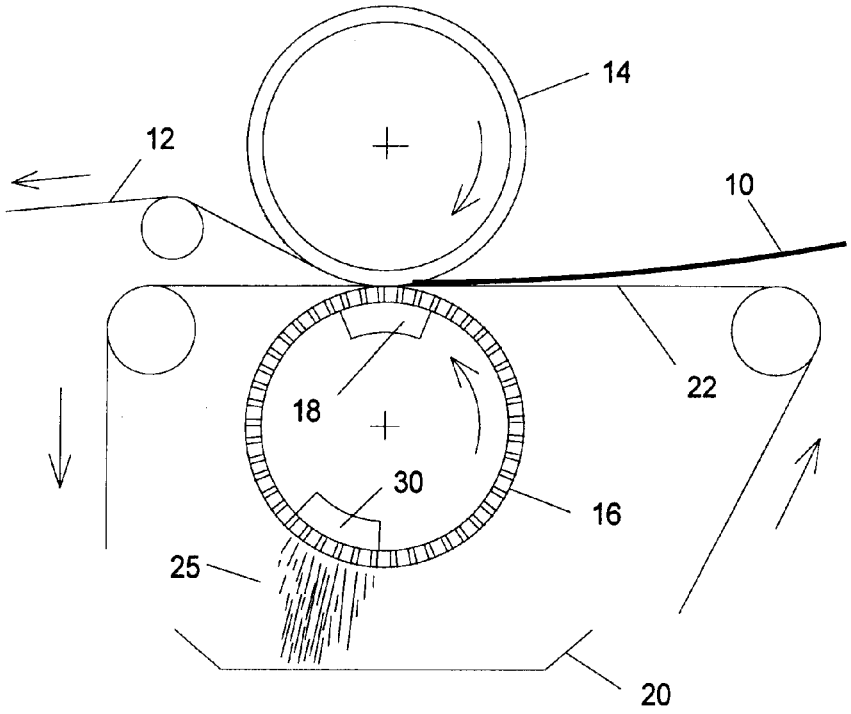
FIG. 3 illustrates a first embodiment of the invention employing an internal blowbox for dewatering a suction press roll.

In FIG. 3, a first embodiment of the invention is illustrated employing an internal blowbox 30 arranged at a lower position of a bottom suction press roll. Generally, blowboxes are units which direct the flow of air or other gas under pressure. The blowboxes used in the preferred embodiments form three-sided compartments located within the suction roll shell and span substantially the entire width of the roll along the roll's cylindrical axis. The blow boxes further comprise seal edges for contacting and sealing the compartment with the roll inner surface. They are pressurized with air so that a radially outward flow of air through the through-holes is created in the region between the seal edges.

In these embodiments, the blowbox emits air to blow out residual water 25 from the suction roll holes into the catch pan 20, augmenting the effect of centrifugal and gravity forces. The blowbox can be located at any desirable circumferential position inside the roll 16. The optimal location is influenced by the geometry of the press and its operating parameters.

The blowbox can have a similar design and construction as a conventional suction box used in the same roll. Other designs are acceptable as well. The blowbox can operate with a controllable and adjustable positive air pressure. It has the added benefit of acting as a cleaning mechanism for the suction holes themselves. It can be used as a standalone dewatering aid or in conjunction with an external doctor blade or wipe. When used in conjunction with a doctor blade, the location of the pressurized blowbox can be leading the blade, trailing the blade, coincident with the blade, or positioned in any combination thereof.

The blowbox circumferential width, operating pressure, and circumferential position may be varied as needed to obtain an optimal effect for a given suction roll. In some applications, it may be desirable to operate with a narrow box width and high air pressure, resulting in high velocity air for hole cleaning but at a relatively low air consumption rate. It can be operated at a single pressure, or can be compartmentalized in the circumferential direction to provide regions of low and high air pressures if warranted (analogous to a suction couch roll with low and high vacuum zones).

While the blowbox can obviate the need to use the conventional doctor blades or wipes to remove water from the suction holes, it may be used in conjunction therewith. Eliminating doctor blades reduces roll or roll cover wear and blade wear. The blowbox air pressure and dewatering capacity can be adjustably controlled, and the blowbox creates more uniform and more efficient dewatering across the width of the roll, as compared to doctor blades and wipes. The outward air velocity through the holes not only expels water, but also cleans the holes by expelling debris such as papermaking fines, filler, felt hair, and the like. Since all parts can be located inside the roll shell, the invention allows for compactness and use in suction presses where there is limited access.

Figure 4:
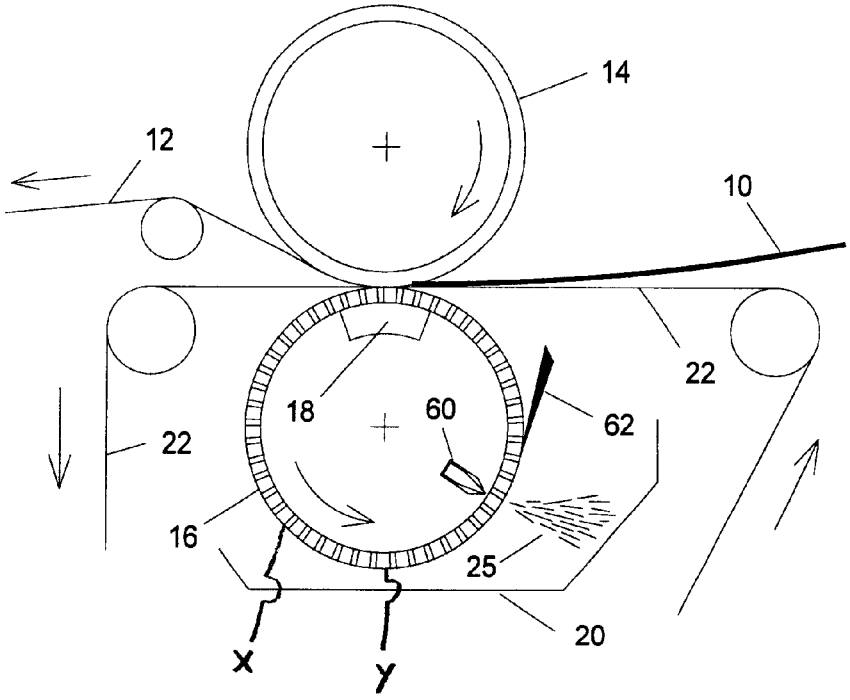
FIG. 4 illustrates an internal air knife and an external doctor blade combination as a second embodiment of the invention.

In a second embodiment of the invention, an air knife, air pipe, or other type of non-contact air delivery system (such as an air shower) is employed for dewatering the through-holes of the suction roll. Referring to FIG. 4, a non-contact air delivery device 60 is shown at a lower circumferential position of the roll in close proximity to the shell interior. Residual water 25 blown out from the through-holes is captured in catch pan 20. A doctor blade 62 or wipe may also be positioned downstream of the air delivery device 60 to remove any remaining surface moisture and/or debris from the roll surface. Throughout this application the term "downstream" means further along the path of a rotating roll, with the suction box being the starting point. For example, in FIG. 4, point "y", which is roughly at the 6 o'clock position, is downstream from point "x", which is roughly at the 7 o'clock position, because the roll in FIG. 4 will rotate in a counter-clockwise direction, as indicated, and point "y" has moved further from the suction box. In FIG. 4, Point x can also be referred to as being "upstream" from point y.

Figure 5:
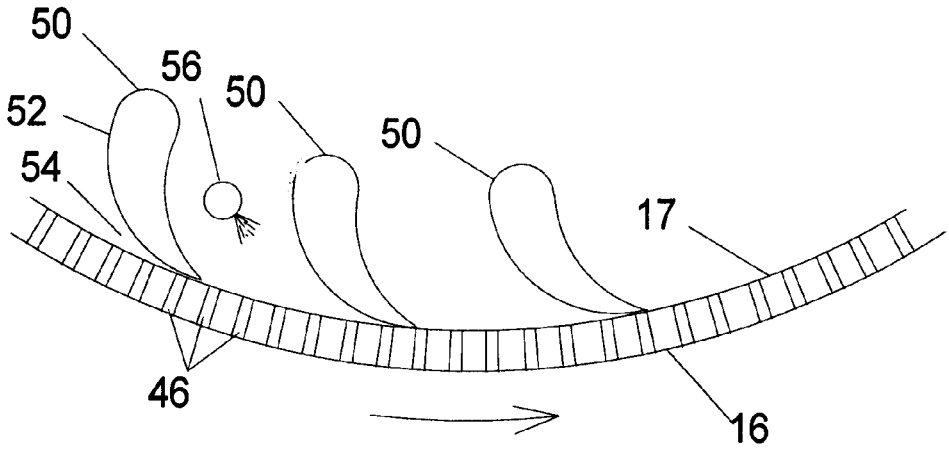
FIG. 5 illustrates another embodiment of the invention which employs a series of stationary air foils arranged against the inner surface of a suction roll as a third embodiment of the invention.

In a third embodiment of the invention, one or more stationary air foils may be used to create a corresponding number of pressure pulses which augment the natural centrifugal forces acting on the water in the holes. Referring to FIG. 5, three such foils 50 are shown positioned along the inside surface 17 of the suction roll shell. These foils have a tapered surface 52 such that a pressure wedge 54, which is a relatively high pressure region, is created. This pressure wedge exerts a radially outward force and flow through the suction holes 46, thereby expelling residual water. Stationary foils of the type depicted in FIG. 5 may also be combined with an external doctor blade, wipe, or air knife to remove surface water from the roll. In addition, low pressure air may be introduced with a pipe 56 or other delivery means ahead of the air foil(s) to create an even larger pressure region 54.

As used herein, the term "air knife" refers to a pressurized air delivery device, or a series of devices as needed to substantially span the cross-directional width of the suction roll, which emits a relatively high velocity flow of air from an elongated plenum through a relatively narrow and elongated slot. In the preferred embodiments, the width of the slot is between 0.001" and 0.125", the speed of the air upon exiting the slot is greater than 800 feet per minute and the air knife(s) do not contact the surface of the suction roll. The air knife can be a commercially available air knife, such as can be purchased from ExAir Corporation, Cincinnati, Ohio. It can also be in the form of a pressurized pipe or tube containing a narrow slot through the pipe or tube wall, this slot being essentially parallel to the axis of the pipe or tube. Air knives are commonly used in a number of industries for drying, cleaning, doctoring, and the like. An air knife can be constructed from any number of suitable materials and dimensioned to work with a range of slot widths.

As used herein, the term "air shower" refers generally to a pressurized air delivery device, or a series of devices as needed to substantially span the cross-directional width of the suction roll, which emits air through a series of nozzles or holes in a direction towards the inner surface of the suction roll shell. In the preferred embodiments, the air shower is a drilled pipe or tube, with hole diameters ranging from 0.010 inch to 0.125 inch, and is located within the suction roll.

Further, as used herein, the term "air pipe" refers generally to a pressurized air delivery device whose function is simply to admit air to a specific region inside of the suction roll shell. An example of an air pipe is an open-ended tube or pipe, or a crudely perforated pipe.

For use within paper machine suction rolls, the air knife is preferably of stainless steel or aluminum construction suitable for the environment inside the roll shell. One or more internal air knives may be used to span the width of the suction roll. The distance from the air knife slot to the interior surface of the shell is typically 0.05" to 3.0". In the preferred embodiments the distance is approximately 1.5" or less. Air supply pressure to the air knife, air shower, or air pipe, as measured outside the suction roll, is adjustable and, generally, less than 100 pounds per square inch gauge (psig). In the preferred embodiments the pressures used are less than 80 psig.

Figure 6:
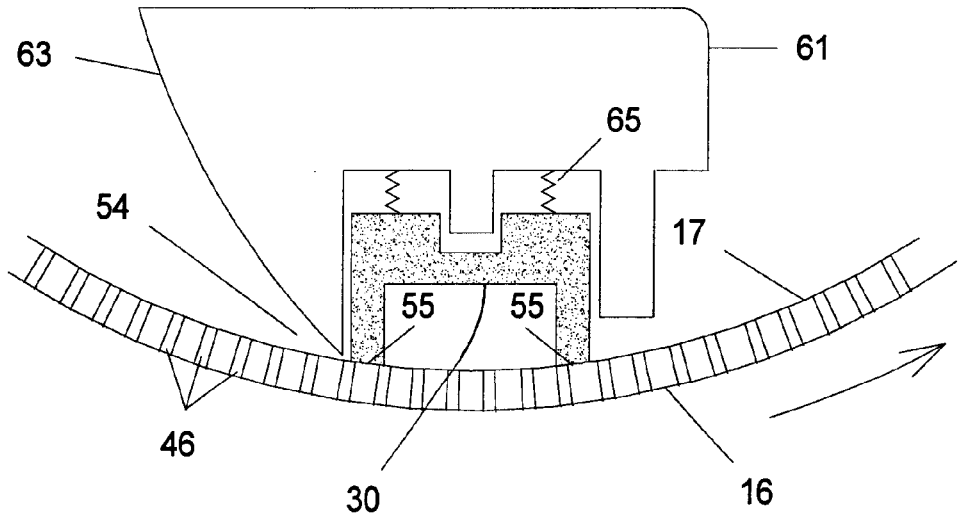
FIGS. 6, 7, and 8 illustrate three alternate arrangements for mounting an internal blowbox in the suction roll with means for pneumatic or spring loading the seal edges of the blowbox against the inner surface of the suction roll.
Figure 7:
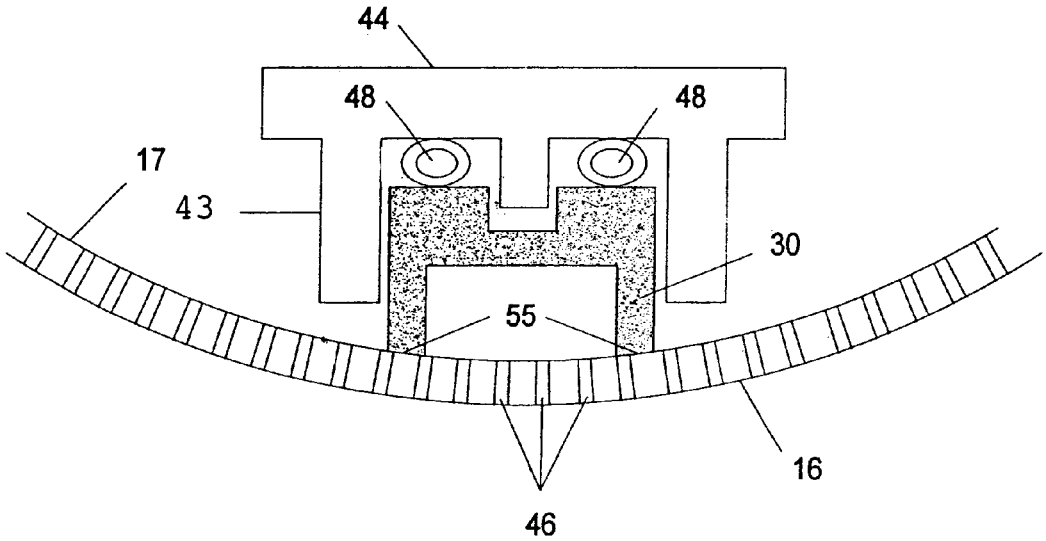
Figure 8:
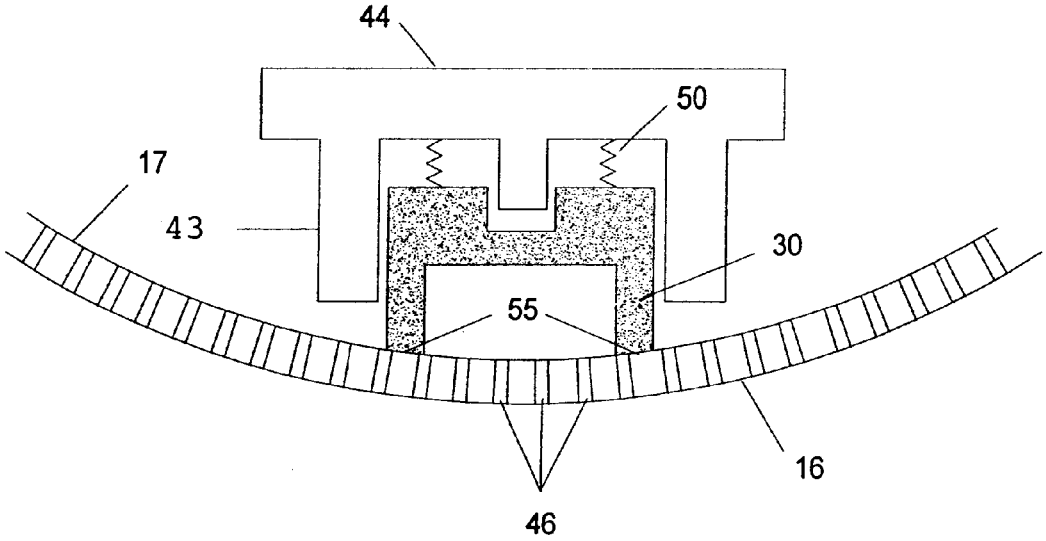

The blowbox 30 as previously described may be mounted in different ways to improve its performance or wear characteristics. As shown in FIG. 6, the blowbox 30 can be biased by springs 65 to place its edges 55 in sealing contact with the inner surface 17 of the moving roll 16. The mounting structure 61 for the blowbox can have a tapering surface 63 that acts to funnel and compress air into an air discharge area 54 to supplement the action of the blowbox 30. With this design, outward air flow is generated by both the tapered surface 63 and the pressurized blowbox 30. Another version shown in FIG. 7 employs flex tubes 48 between the mounting structure 44 and the blowbox 30 to bias the edges 55 into sealing contact with the inner surface 17 of roll shell 16. The channel/guide flanges 43 guide the radial movement of the blowbox toward the shell surface. The version in FIG. 8 employs biasing springs 50 with channel/guide flanges 43 as in FIG. 7, but without the tapering surface as in FIG. 6.

Figure 9A:
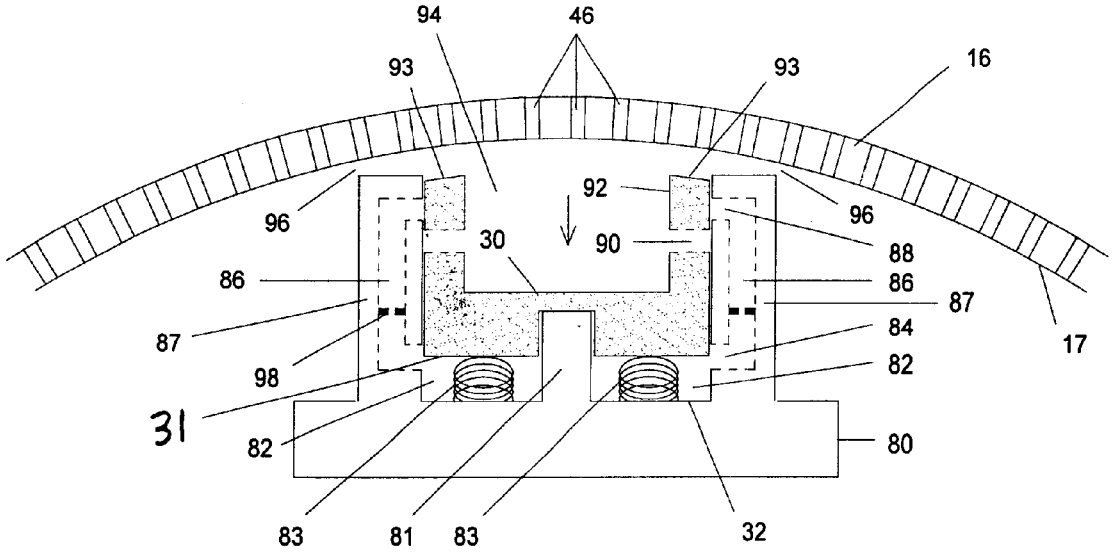
FIGS. 9(*a*) and 9(*b*) illustrate another alternate arrangement for mounting an internal blowbox in the suction roll with means for self-loading of the seal edges of the blowbox against the inner surface of the suction roll.
Figure 9B:
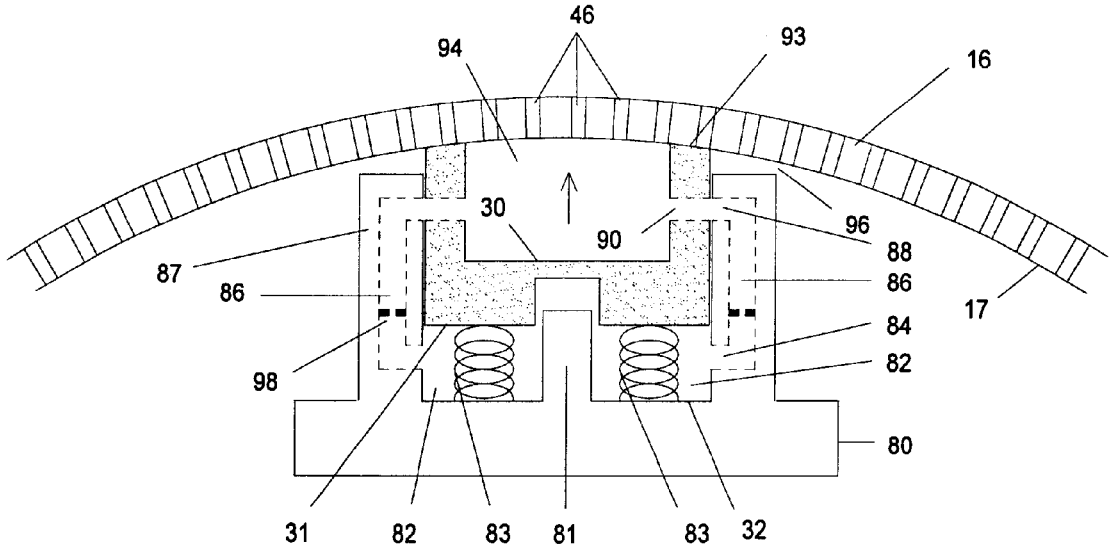

As another feature of the invention, illustrated in FIGS. 9(*a*) and 9(*b*), a self-loading blowbox assembly is provided to allow the blowbox 30 to be controlled so as to seat its seal surfaces 93 of its side arms 92 against the inner surface 17 of the roll shell 16 only as required. Within the mounting structure 80, the blowbox 30 is slideably movable in the radial direction (arrows) with a close fit within the guide flanges 87 having ends spaced from the roll surface by a small gap 96. In the space 82 between the back wall 32 of the mounting structure and the blowbox, tensioning springs 83 are provided for biasing the blowbox away from the roll surface.

As shown in FIG. 9(*a*), when air pressure is not supplied to space 82 and to the two-ended air channel 86 (located inside of each guide flange 87) via "receiving" port 84, the blowbox 30 is pulled back toward the back wall 32 of the mounting structure 80 by the tensioning force of the springs 83. A stop member 81 is provided to positively locate the blowbox in the "disengage" position with its arms 92 pulled away from the roll's interior surface 17. Air channel 86 is in communication with space 82 but is not in communication with air discharge area 94, since the position of the "charging" port 88 does not overlap with aperture 90 when the blowbox is in the "disengage" position. Further, in this "disengage" position, the blowbox is moved out of contact from the roll surface and is not in use.

As shown in FIG. 9(*b*), when sufficient positive air pressure is supplied to space 82 and into channel 86 (pressurizing means are not shown), the resultant upward force acting on the bottom side 31 of the blowbox is greater than the downward force exerted by the tension of the springs 83, resulting in upward movement of blowbox 30. Once the blowbox has moved an adequate amount towards roll 16, the "charging" port 88 begins communicating with the air discharge area 94 via aperture 90 in the blowbox arms (now in registration therewith in the forward position). Air flows from space 82 through receiving port 84, then through channel 86, charging port 88, through aperture 90, into discharge area 94 and, finally, radially outward through the suction holes 46. The blowbox can thus be moved into and out of self-seating contact with roll surface 17 by its own switchable air supply control (not shown).

Flow restrictors 98 can be employed in air channels 86 to ensure that adequate pressure is maintained in space 82 to insure contact and sealing of the blowbox seal surfaces 93 with the inside. surface 17 of roll 16. These flow restrictors can be constructed as simple orifice plates, porous media, or any other design, as their function is solely to create a pressure drop between space 82 and air discharge area 94.

The self-sealing control has potential application in other areas of papermaking, such as in threading operations for the tail transfer between single-tier dryer sections. A momentary discharge of air from a suitably positioned blowbox within a perforated roll shell located in the single-tier dryer section can be used to dislodge and transfer the paper web tail to the next dryer section. In this manner, the blowbox is activated to seat against the perforated roll shell surface and supply the discharge of air only when needed. The blowbox thus only occasionally contacts the shell interior, thereby minimizing seal strip wear during the majority of time when the discharge air is not needed.

Figure 10:
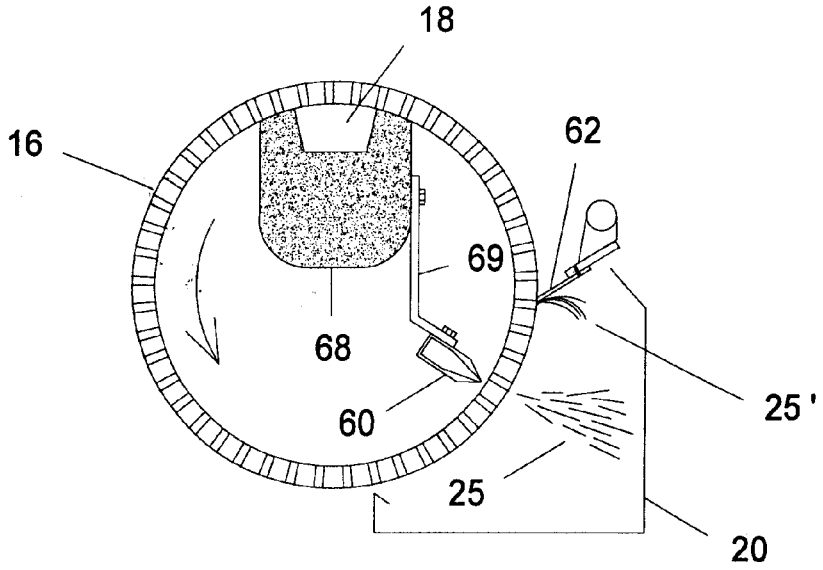
FIGS. 10(*a*) and 10(*b*) illustrate other alternate embodiments of the invention in which an air knife or air shower unit is mounted to the suction box in a suction press roll.
Figure 10:
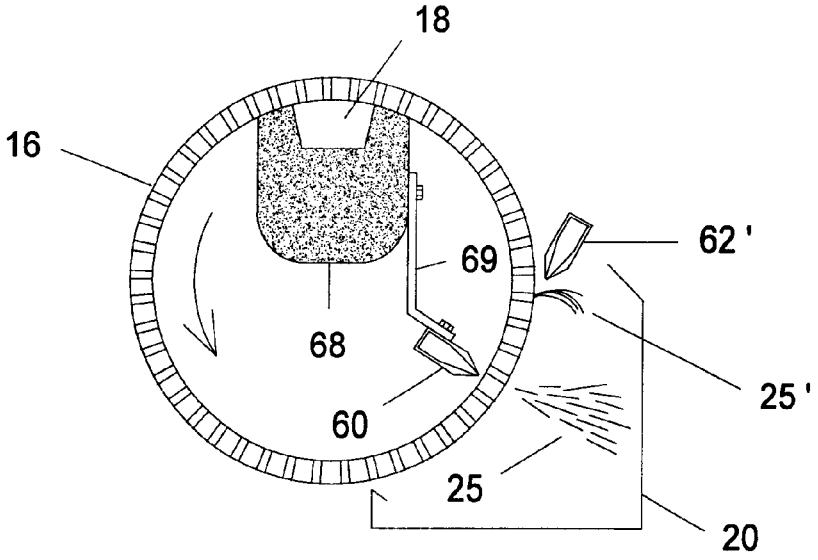

As shown in FIG. 10(*a*), the air knife (or air shower) 60 can be rigidly mounted to the assembly 68 for the vacuum suction box 18 with appropriate mounting brackets 69 and hardware. The mounting can be made adjustable to allow the distance between the air discharge area and the shell inner surface to be changed. Further improvement to dewatering efficiency may be realized with an external doctor blade 62 positioned downstream from the internal (blow-out) air knives, for the purpose of removing surface water 25' or debris from the roll's outer surface. Alternatively, and as shown in FIG. 10(*b*), an external air knife 62' may be used instead of the external doctor blade. The external air knife is advantageous in that outer surface wear of the roll due to doctoring is eliminated. In contrast to an internal air knife for blowing water out of the holes, for which air velocity is substantially perpendicular to the inner roll surface, air velocity of the external air knife 62' is substantially tangent to the outer roll surface, with air velocity substantially opposite the direction of roll rotation.

Figure 11:
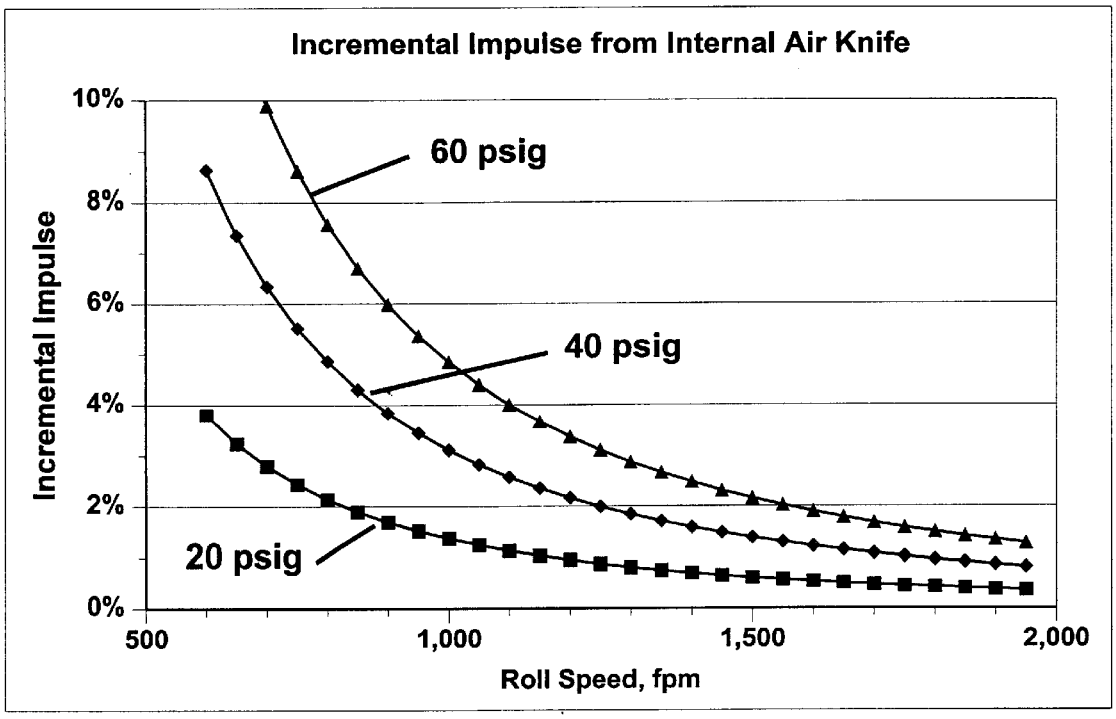
FIG. 11 is a chart showing the percent incremental impulse available for hole dewatering from an internal air knife in relation to the roll speed for air knife pressures of 20, 40, and 60 pounds per square inch gauge (psig).

Use of an internal (blow-out) air knife provides forces for dewatering and cleaning the suction and through-holes above and beyond that available from centrifugal forces alone. As shown in the graph in FIG. 11, obtained from typical performance data published by ExAir Corporation, Cincinnati, Ohio, for their stainless steel Super Air Knife™, an incremental impulse resulting from the air knife forces is calculated as a function of roll surface speed for a press roll having an outside diameter (O.D.) of 31.4 inches. As used herein, impulse is defined as the time integral of the outward forces acting on residual water in the through-holes of the suction roll over one revolution of the roll. A higher impulse results in greater hole dewatering efficiency. The incremental impulse is the impulse above and beyond that provided by centrifugal forces alone. Parameters used in these calculations include knife air supply pressure, knife slot width, amount of residual water in a typical hole (assumed to be 5% of the hole volume for results in FIG. 11.), distance between knife and shell inner surface, roll diameter, hole diameter, and hole depth. The results show that significant increases in impulse, particularly at the lower roll speeds, can be generated with an internal (blow-out) air knife (curves for 20, 40, and 60 psig knife pressures are shown). The percentage of incremental impulse available decreases as rotational speed increases, due to higher centrifugal forces at higher speeds and the reduced amount of time that the pressurized air contacts a given area of suction roll surface (i.e. because the roll surface passes the air knife more quickly).

EXAMPLE

An air knife, from ExAir Corp., with a 0.002" slot width was installed inside the shell of a 31.4" O.D. suction press roll in the first press position of a commercial paper machine. The press roll had 0.125" diameter suction holes, each approximately 2.3" in depth (as measured through both roll shell and roll cover). The first press had a single-felted nip between two press rolls, with the felt on the top side of the sheet. The suction press roll is the top roll in this press, and the suction roll contained an internal suction box in the area of nip contact with the bottom roll, operating at a vacuum of 20" mercury. Rotation of the suction roll was clockwise, and that of the bottom roll counter-clockwise. The suction press roll was equipped with a doctor blade at the 3 o'clock position, which served to remove residual water and debris from the roll surface. The air knife was positioned inside the suction roll at a 2 o'clock circumferential position, and the discharge line of the air knife was positioned 1" from the inner surface of the shell. The doctor blade trailed the air knife by about 8 inches, as measured along the outer circumference of the top press roll.

The effectiveness of the internal air knife was evaluated during two production runs of paper having a basis weight of 138 grams per square meter product at first press speeds of 1,070 and 1,100 feet per minute, respectively. The observations were as follows. Prior to supplying air pressure to the air knife, no water was being thrown from the roll, i.e., no water droplets were seen leaving the surface of the roll anywhere along the roll circumference. At an air knife pressure of 33 psig, a slight change could be seen wherein residual water was moved to the outer surface of the roll where it was removed by the doctor blade. Additional water was seen to be removed from the holes, i.e., physically thrown from the surface of the roll, as pressure to the air knife was increased to about 38 psig. At air knife pressures of 50 and 60 psig, a large amount of residual hole water was clearly being thrown from the roll directly above the location of the air knife with sufficient force that the majority of this thrown water was approximately 1 to 2 inches above or away from the roll surface at the location of the doctor blade, i.e., approximately 8 inches downstream of the internal air knife.

It is to be understood that many modifications and variations may be devised given the above description of the principles of the invention. It is intended that all such modifications and variations be considered as within the spirit and scope of this invention, as it is defined in the following claims.

We claim:

1. An apparatus comprising:

a rotating cylindrical shell with an inner circumferential surface defining an inner volume, a multiplicity of through-holes being formed in said shell;

a suction box mounted in said inner volume for applying a suction force to said through-holes for receiving water from outside said rotating cylindrical shell; and a dewatering apparatus mounted in said inner volume and comprising an inlet for receiving pressurized gas and an outlet for emitting said received pressurized gas, said outlet being in the form of an elongated slot that is disposed so that the gas flow exiting said slot is substantially normal to and impinges upon said inner circumferential surface at a circumferential position downstream from said suction box, said dewatering apparatus emitting gas with sufficient velocity to eject residual water or debris outwardly from through-holes that pass in front of said elongated slot.

2. The apparatus as recited in claim 1, wherein said velocity is greater than 800 feet per minute.

3. A dewatering apparatus for dewatering a suction roll used to remove water from a paper web, press felt, or forming fabric in papermaking, the suction roll having a cylindrical shell with inner circumferential surface defining an inner volume, through-holes formed in the shell, and a suction box mounted in its inner volume for applying a suction force to the through-holes for receiving water from the paper web, press felt, or forming fabric, the dewatering apparatus comprising an air knife formed by an elongated slot outlet mounted in the inner volume of the suction roll at a downstream circumferential position from the suction box for delivering air flow against the inner surface of the suction roll to expel residual water or debris outwardly from the through-holes.

4. A dewatering apparatus according to claim 3, further comprising a doctor blade, wipe or air knife provided along an outer surface of the suction roll for removing surface water from the outer surface of the suction roll.

5. An assembly comprising a mounting structure, a self-loading blowbox slidably supported by said mounting structure, and biasing means arranged between said mounting structure and said blowbox for urging said blowbox to slide along an axis between extended and retracted positions, wherein said mounting structure comprises first and second guide flanges within which the blowbox is slideably movable with a close fit, and a back wall separated from said blowbox by a back space, further comprising a two-ended air channel having at one end a receiving port communicating with the back space and at another end a charging port communicating with a front space between sealing edges of the blowbox when the blowbox is in said extended position, wherein when insufficient air pressure is supplied into the backspace, the blowbox is pulled toward said retracted position by said biasing means, and wherein when sufficient air pressure is supplied into the backspace, the blowbox is pushed outward toward said extended position, thereby engaging the charging port with the front space through an aperture in the blowbox and allowing a flow of air from said backspace to said front space.

6. The assembly as recited in claim 5, wherein said air channel is built into one of said guide flanges of said mounting structure.

7. A dewatering apparatus for dewatering a suction roll used to remove water from a paper web, press felt, or forming fabric in papermaking, the suction roll having a cylindrical shell with inner circumferential surface defining an inner volume, through-holes formed in the shell, and a suction box mounted in its inner volume for applying a suction force to the through-holes for receiving water from the paper web, press felt, or forming fabric, the dewatering apparatus comprising a blowbox mounted in the inner volume of the suction roll at a downstream circumferential position from the suction box for delivering air flow against the inner surface of the suction roll to expel residual water or debris outwardly from the through-holes, pneumatic control means for selectively loading the blowbox into and out of contact with the inner surface of the suction roll, and a mounting structure having guide flanges within which the blowbox is slideably movable in radial directions with a close fit, a back space between a back wall of the mounting structure and the blowbox containing spring means for biasing the blowbox inward and away from the inner surface of the suction roll shell, said mounting structure comprising at least one two-ended air channel provided inside at least one guide flange having at one end a receiving port communicating into the back space at the back of the blowbox, and at another end a charging port communicating into a front space between sealing edges of the blowbox and the inner surface of the suction roll, wherein when insufficient air pressure is supplied into the backspace, the blowbox is pulled away from the suction roll by the spring means, thereby breaking contact between the inner surface of the suction roll and the sealing edges of the blowbox, and wherein when sufficient air pressure is supplied into the backspace, the blowbox is pushed outward toward the inner surface of the suction roll, thereby engaging the charging port with the front space through an aperture in the blowbox and allowing a radially outward flow of air through the through-holes in the suction roll.

8. A dewatering apparatus for dewatering a suction roll used to remove water from a paper web, press felt, or forming fabric in papermaking, the suction roll having a cylindrical shell with inner circumferential surface defining an inner volume, through-holes formed in the shell, and a suction box mounted in its inner volume for applying a suction force to the through-holes for receiving water from the paper web, press felt, or forming fabric, the dewatering apparatus comprising a blowbox mounted in the inner volume of the suction roll at a downstream circumferential position from the suction box for delivering air flow against the inner surface of the suction roll to expel residual water or debris outwardly from the through-holes, wherein the blowbox is mounted to a mounting structure which is tapered so as to act as an air foil.

9. A dewatering apparatus according to claim 8, further comprising biasing means disposed between the mounting structure and the blowbox for biasing sealing ends of the blowbox into contact with the inner surface of the suction roll.

10. A dewatering apparatus according to claim 9, wherein the biasing means are biasing springs.

11. A dewatering apparatus according to claim 9, wherein the biasing means are elastically flexible tubes.

* * * * *